US012441521B2

(12) United States Patent
Landa Fernandez de la Bastida et al.

(10) Patent No.: US 12,441,521 B2
(45) Date of Patent: Oct. 14, 2025

(54) AUTOMATIC LOCKING HINGE MECHANISM

(71) Applicant: SNA EUROPE INDUSTRIES IBERIA, S. A., Álava (ES)

(72) Inventors: Hodei Landa Fernandez de la Bastida, Álava (ES); Thibaut Deluca-Verley, Kenosha, WI (US)

(73) Assignee: SNA EUROPE INDUSTRIES IBERIA, S. A., Araba/Alava (ES)

( * ) Notice: Subject to any disclaimer, the term of this patent is extended or adjusted under 35 U.S.C. 154(b) by 0 days.

(21) Appl. No.: 18/665,207

(22) Filed: May 15, 2024

(65) Prior Publication Data

US 2024/0391654 A1 Nov. 28, 2024

(30) Foreign Application Priority Data

May 24, 2023 (ES) ..... ES202330891U

(51) Int. Cl.
*B65D 43/16* (2006.01)

(52) U.S. Cl.
CPC ..... *B65D 43/162* (2013.01); *B65D 2251/105* (2013.01); *B65D 2543/00101* (2013.01)

(58) Field of Classification Search
CPC ..... B65D 17/4012; B65D 17/02; B65D 2517/0014; B65D 2517/0062; B65D 2517/0073; B65D 2517/0077; B65D 23/0871; B65D 2517/0082
See application file for complete search history.

(56) References Cited

U.S. PATENT DOCUMENTS

| | | | | | |
|---|---|---|---|---|---|
| 2,734,222 | A * | 2/1956 | Kiba | E05D 7/1077 | 16/257 |
| 2,960,254 | A * | 11/1960 | Kiba | E05D 7/1077 | 220/840 |
| 3,023,923 | A * | 3/1962 | Geib | A45C 13/00 | D9/423 |
| 4,349,120 | A * | 9/1982 | DiNardo | B65D 43/164 | 220/831 |
| 4,967,924 | A * | 11/1990 | Murofushi | H02G 3/14 | 220/831 |
| 5,529,205 | A * | 6/1996 | Corney | B65D 43/24 | 220/840 |
| 6,000,550 | A * | 12/1999 | Simpson | H01L 21/67386 | 16/257 |
| 8,283,576 | B2 | 10/2012 | Shell et al. | | |
| 9,673,599 | B2 | 6/2017 | Ketterer | | |
| 10,069,284 | B1 | 9/2018 | Paul | | |
| 2006/0283869 | A1 | 12/2006 | Soncini | | |

* cited by examiner

*Primary Examiner* — James N Smalley
(74) *Attorney, Agent, or Firm* — Craft Chu PLLC; Andrew W. Chu

(57) ABSTRACT

A hinge with automatic locking includes at least one rotation attachment, linked to the upper lid, capable of rotating around the stem, linked to the lower lid. Between each rotation attachment, there is, in the upper lid, at least one locking attachment facing the retaining attachment of the lower lid in the closed position of the lids, capable of rotating with the upper lid to a locking position with the lids open.

1 Claim, 4 Drawing Sheets

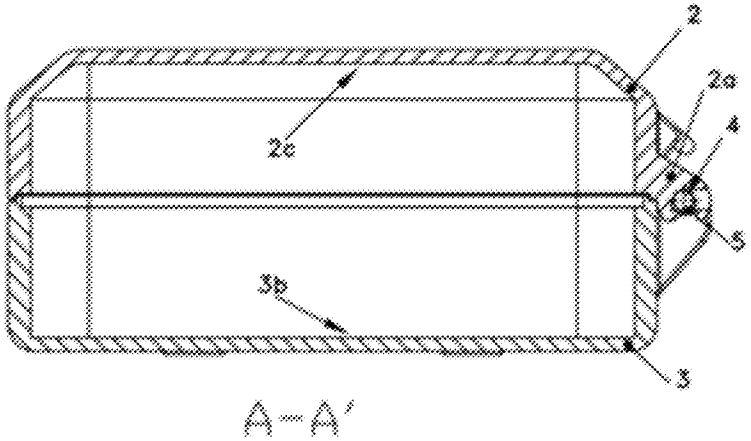
Fig. 2.1
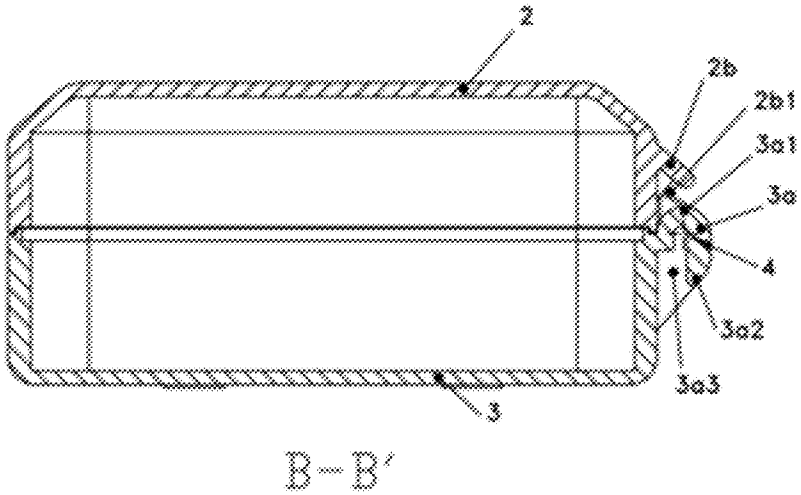
Fig. 2.2

AUTOMATIC LOCKING HINGE MECHANISM

STATEMENT REGARDING FEDERALLY SPONSORED RESEARCH OR DEVELOPMENT

Not applicable.

CROSS-REFERENCE TO RELATED APPLICATIONS

See Application Data Sheet.

The Names of Parties to a Joint Research Agreement

Not applicable.

Incorporation-by-Reference of Material Submitted on a Compact Disc or as a Text File Via the Office Electronic Filing System (Efs-Web)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention concerns a hinge mechanism with automatic locking, such as those used in the joining of two elements that rotate around the joint up to a predetermined angle at which automatic locking occurs, as in the case of containers, such as tool boxes or briefcases that contain elements on the internal faces of their lids and allow the lids to be opened and closed through a rotating movement and the locking, and voluntary unlocking, of the hinge automatically with the opening of the lid.

2. Description of Related Art Including Information Disclosed Under 37 CFR 1.97 and 37 CFR 1.98

Currently and as a reference to the state of the art, small containers are known that can be opened without locking the hinge. The use of external elements such as clamps or pneumatic elements that allow the lid to be kept in a position that locks the rotation of the upper lid is also known, but these elements do not guarantee the correct closure in the event of an accidental impact or knock.

In addition, hinges with friction locks are known that, by means of levers, springs and clutches, drive toothed gears that allow the hinge to be locked by friction and unlocked when the gear is removed. These types of hinges are suitable for use with large elements and forces such as door profiles, but for small elements they are unsuitable as the components must be manufactured in small dimensions that become clogged and prevent correct operation, and require the use of a lever or similar for their operation, as well as additional parts that make the hinge mechanism more expensive.

Ratchet-locking hinges are also known in which a mobile element, usually spring-loaded, engages in a recess in the hinge when the hinge is opened, providing a mechanical lock against unintentional closure. In order to unlock this type of hinge, it is necessary to compress the spring at the same time that the closing movement is initiated to prevent the ratchet from re-engaging. These hinges, in addition to requiring both hands to operate, present problems of possible pinching when operating the spring in the vicinity of the moving hinge, as well as unwanted stresses on the components.

BRIEF SUMMARY OF THE INVENTION

Faced with this state of affairs, the present invention refers to a hinge mechanism with automatic locking (1) comprising at least two rotation attachments (2*a*), linked to the upper lid (2) capable of rotating around the stem (5) linked to the lower lid (3), and between each rotation attachment (2*a*) there is in the upper lid (2) at least one locking attachment (2*b*) facing the retaining attachment (3*a*) of the lower lid (3) in the closed position and capable of rotating with the upper lid (2) to a locking position with the upper lid (2), open with regard to the lower lid (3). This allows the box to be kept open on uneven surfaces, allowing the content of the elements housed on the inner faces of the lids to be clearly seen, which is very important for containers that incorporate small-sized elements on the inner faces of their lids (6) such as tips and sockets of different sizes for tools. This facilitates access to these elements by automatically locking the opening of the lid in the most optimal position according to the use of the container to which it is linked.

The linking of the elements of the hinge mechanism with automatic locking (1) to the upper lid (2) and the lower lid (3), allows both an embodiment with mechanical linkage to the lid (fastened to the lids (6) by mechanical means such as nails or screws or any other usual means of joining, as is usual in hinges), as an integrated implementation in the single piece lid (generating the lid with the integrated hinge by injection, moulding, etc.). This possibility of manufacturing the upper lid (2) in one piece with the elements linked to the upper lid and a lower lid (3) with the elements linked to the lower lid, allows the use of a wide variety of materials such as plastics, resins, metals, etc., thereby reducing the manufacturing cost by requiring fewer parts for the correct functioning of the hinge.

To carry out the locking, the retaining attachment (3*a*) comprises an angled end (3*a*1) and a chamfered end (3*a*2) which allow the free rotation of the locking attachment (2*b*) to the locking position in which the locking recess (2*b*1) of the locking attachment (2*b*) is capable of housing the chamfered end (3*a*2) of the retaining attachment (3*a*) and, in turn, the retaining recess (3*a*3) is capable of partially housing the locking attachment (2*b*).

Thanks to this configuration, the locking of the lid, at a predetermined opening angle that is determined by the arrangement and geometry of the retaining attachment (3*a*) and the dimensions of the retaining recess (3*a*3) and the locking recess (2*b*1), occurs automatically with the lid opening movement, and unlocking of the lid occurs automatically by closing the upper lid (2), without the need to operate additional elements such as springs or levers that deteriorate over time, the materials not being subjected to continuous elastic stresses that weaken them and determine a low resistance and obsolescence of the product. This also allows the position of the hands to be kept away from moving elements and prevent possible entrapment or pinching. The simplicity of the unlocking mechanism also allows this task to be carried out with only one hand and even with work gloves, as it does not require the activation of any additional element, which is an advantage in work environments such as construction sites, assembly sites, etc.

BRIEF DESCRIPTION OF THE SEVERAL VIEWS OF THE DRAWINGS

In order to better understand the nature of the invention, the attached drawings show an industrial embodiment that is merely an illustrative and non-limiting example. The figures refer to an exemplary embodiment with the locking position set at an opening angle of 180°.

FIG. 2.1 shows a section in section A-A' in which the rotation attachment (2*a*), stem (5) and its rotation axis (4) can be seen when the upper lid (2) is closed over the lower lid (3).

FIG. 2.2 shows a section in section B-B' in which the locking attachment (2*b*) and the retaining attachment (3*a*) can be seen when the upper lid (2) is closed over the lower lid (3).

Figure 1:
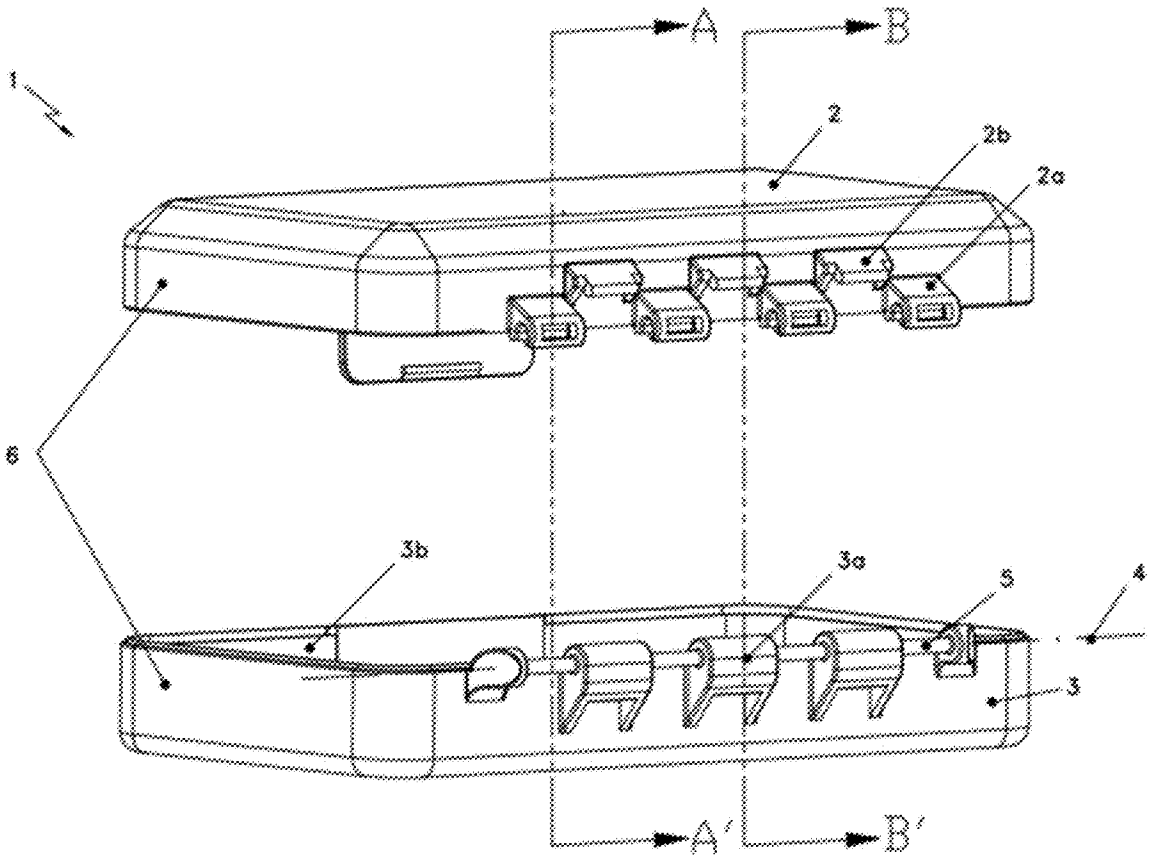
FIG. 1 shows an exploded perspective of the hinge mechanism with automatic locking (1) integrated in a small container together with the upper lid (2) and lower lid (3) in a closed position.

The following references are indicated in these figures:

1. Hinge mechanism with automatic locking
2. Upper lid
  2*a*. Rotation attachment
  2*b*. Locking attachment
    2*b*1. Locking recess
  2*c*. Internal face of the upper lid
3. Lower lid
  3*a*. Retaining attachment
    3*a*1. Angled end
    3*a*2. Chamfered end
    3*a*3. Retaining recess
  3*b*. Internal face of the lower lid
4. Rotation axis
5. Stem

DETAILED DESCRIPTION OF THE INVENTION

In relation to the drawings and references listed above, a preferred mode of execution of the object of the invention is illustrated in the attached drawings, referring to a hinge mechanism with automatic locking (1) comprising at least one rotation attachment (2*a*), linked to the upper lid (2) capable of rotating around the stem (5) linked to the lower lid (3), in which between each rotation attachment (2*a*) there is at least one locking attachment (2*b*) in the upper lid (2) facing the retaining attachment (3*a*) of the lower lid (3) in the closed position and capable of rotating with the upper lid (2) to a locking position with the upper lid (2) open with regard to the lower lid (3).

Figure 3:
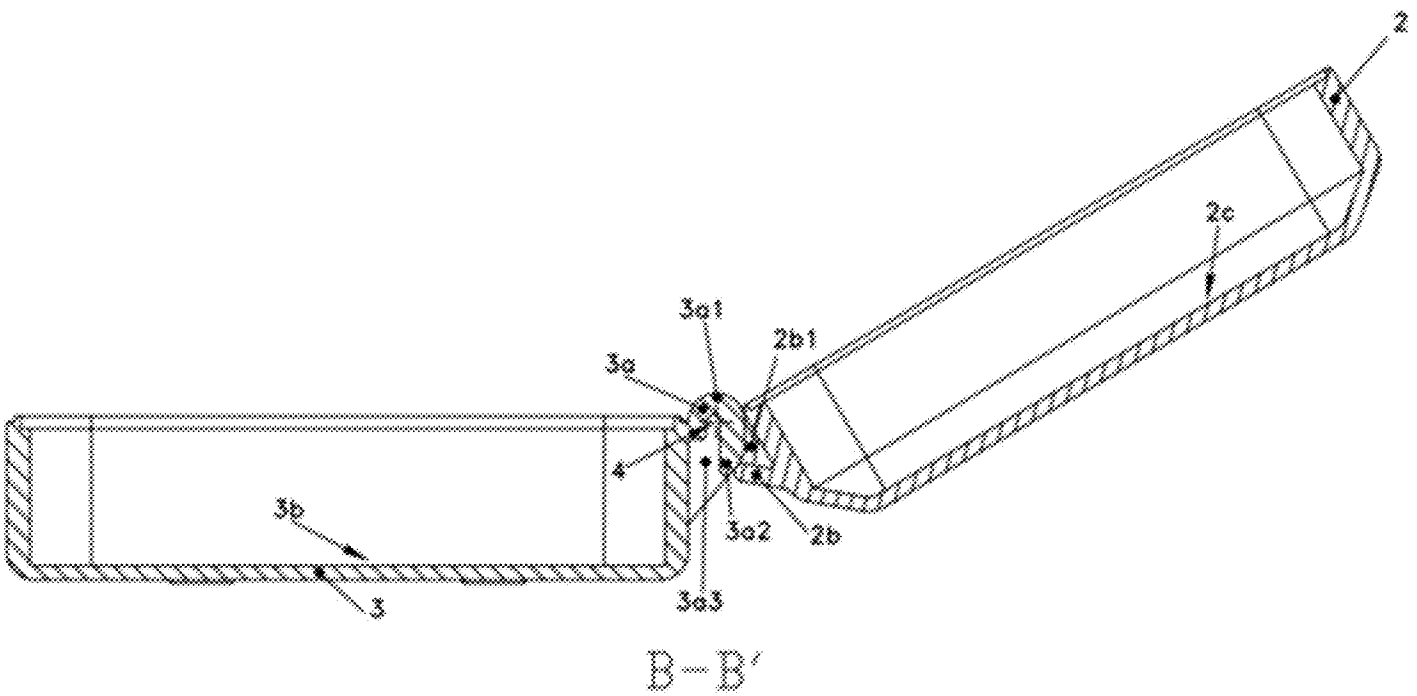
FIG. 3 shows a section in section B-B' in which the locking attachment (2*b*) and the retaining attachment (3*a*) can be seen when the upper lid (2) is in a 150° semi-open position with regard to the lower lid (3).
Figure 4:
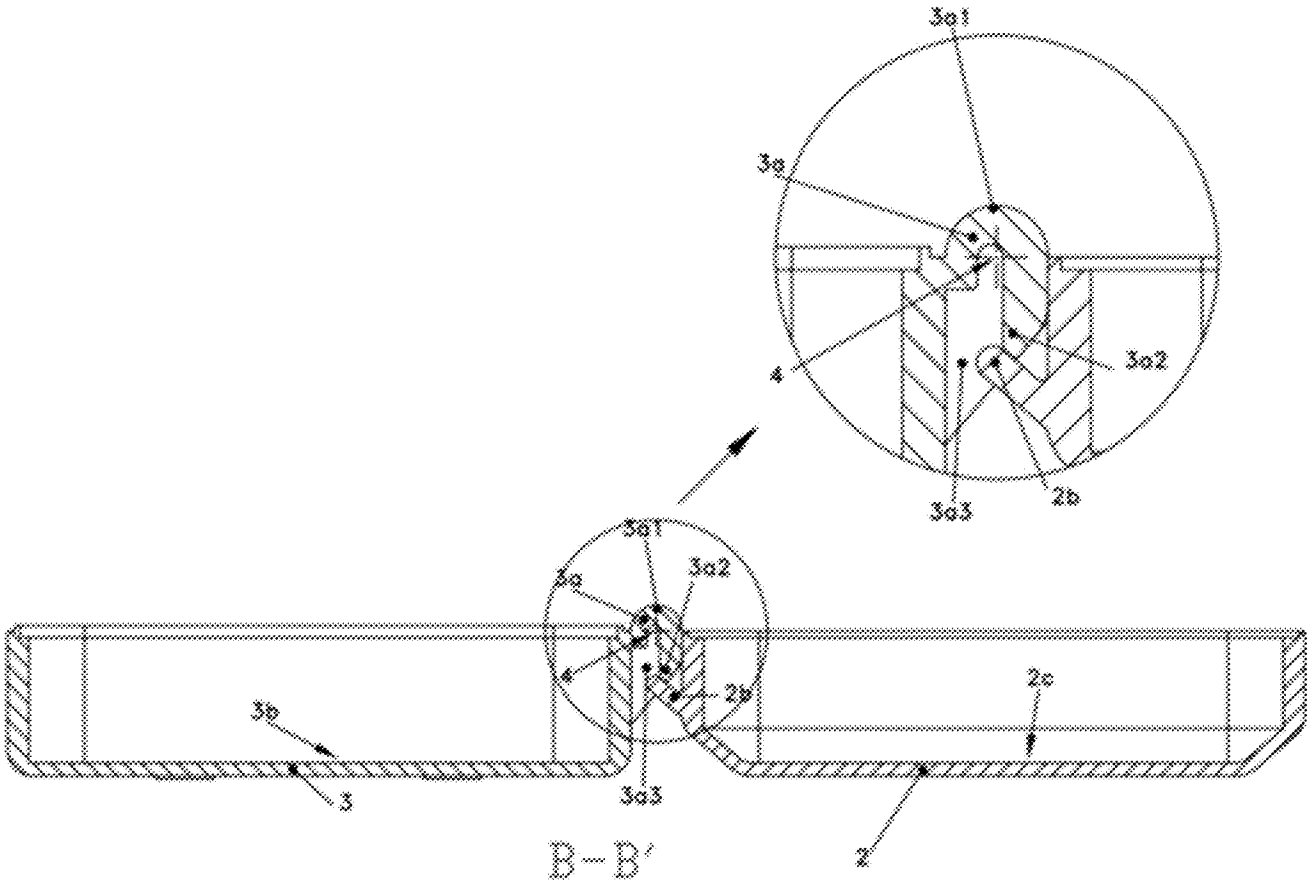
FIG. 4 shows a section in section B-B' in which the locking attachment (2*b*) and the retaining attachment (3*a*) can be seen when the upper lid (2) is in the open position 180° with regard to the lower lid (3) and in which the locking of the hinge can be seen and how the locking recess (2*b*1) of the locking attachment (2*b*) houses the chamfered end (3*a*2) of the retaining attachment (3*a*) and in turn, the retaining recess (3*a*3) partially houses the locking attachment (2*b*).

The drawings illustrate the various positions that the upper lid takes from its closed position, or 0°, in FIGS. 1, 2.1 and 2.2 to its locked position, or 180°, in the exemplary embodiment in FIG. 4, passing through an intermediate or approach position depicted at 150° in the exemplary embodiment of FIG. 3. Although the hinge mechanism is described in this embodiment with lock and retention at 180°, the present invention can be applied to locking and retention at other desired angles by varying the dimensions of the retaining attachment (3*a*), the retaining recess (3*a*3) and, respectively, the locking recess (2*b*1).

FIG. 1 shows the hinge mechanism with automatic locking (1) in a closed position in which the connection of the rotation attachment (2*a*) and the locking attachment (2*b*) to the upper lid (2) can be seen and from the retaining attachment (3*a*) and the stem (5) to the lower lid (3). This connection of the elements of the hinge mechanism with automatic locking (1) means that with an embodiment comprising a single piece of the upper lid (2) and a single piece in the lower lid (3), the free rotation movement of the hinge can be locked or retained, and allows the hinge to be manufactured by injection, moulding, etc. without the need to add additional parts such as independent parts of the hinge, elements for joining the hinge to the lids (6), or stems (5), thereby allowing significant savings in the manufacturing and assembly of the hinge.

In this position (FIG. 2.1), the rotation attachment (2*a*) is assembled with the stem (5) to rotate around its rotation axis (4) in the opening movement of the upper lid (2).

FIG. 2.2 shows in detail the locking attachment (2*b*), linked to the upper lid (2), facing the retaining attachment (3*a*), linked to the lower lid (3), in the 0° closed or start-of-opening position. In this position, the locking attachment (2*b*) is located above the angled end (3*a*1) of the retaining attachment (3*a*) without protruding from it. Thanks to this configuration, the locking attachment (2*b*), which could be susceptible to breakage due to impacts, is protected by the retaining attachment (3*a*), of dimensions correlative to the rotation attachment (2*a*).

FIG. 3 shows an intermediate position between the closed lid and the locking position. In this exemplary embodiment, the moment the lid is opened and reaches 150° is shown. As the lid is opened, the locking attachment (2*b*) rotates freely with the upper lid (2) around the rotation axis (4) of the stem (5), approaching the chamfered end (3*a*2) of the retaining attachment (3*a*). This free rotation is possible thanks to the geometric configuration of the retaining attachment (3*a*) which allows the rotation of the locking attachment (2*b*) without interference with its angled end (3*a*1) until it makes contact with its chamfered end (3*a*2), by which it slides, guided by the shape of the chamfer.

FIG. 4 shows the locking position (180° opening, in the exemplary embodiment for locking at 180°, in which the upper lid (2) is open with regard to the lower lid (3) at 180°). The locking attachment (2*b*) slides over the chamfered end (3*a*2) until, in this position shown in the figure, the chamfered end (3*a*2) of the retaining attachment (3*a*) is lodged in the locking recess (2*b*1) of the locking attachment (2*b*), whose shape and angles correspond to the shape and angles of the retaining attachment (3*a*).

In this way, the locking attachment (2*b*) is partially housed in the retaining recess (3*a*3), allowing the automatic locking and retention of the upper lid (2) with regard to the lower lid (3) and preventing the unintentional closure of the upper lid (2) thanks to the contact of the locking attachment (2*b*) with the chamfered end (3*a*2) of the retaining attachment (3*a*) and the angle of the chamfered end (3*a*2) coinciding with the angle of the locking attachment (2*b*).

Other possible locking executions at other closing angles would be possible by modifying the angle of the retaining attachment (3*a*) at its angled end (3*a*1) thus setting the angle at which the outer face of the retaining attachment (3*a*) comes into contact with the face adjacent to the upper lid (2) of the locking recess (2*b*1), thereby determining the maximum opening angle of the upper lid (2) with regard to the lower lid (3) and respectively modifying the locking recess (2*b*1) and the retaining recess (3*a*3), or by modifying the location of the locking attachment (2*b*) and respectively modifying the geometry of the retaining attachment (3*a*).

Variations in materials, shape, size and arrangement of the component elements, described in a non-limiting manner, do not alter the essentiality of this invention, and this is sufficient to proceed with its reproduction by an expert.

We claim:

1. A hinge with automatic locking, comprising:

at least one rotation attachment, being linked to an upper lid and being configured to be rotatable around a stem, the stem being linked to a lower lid; and at least one locking attachment for the at least one rotation attachment, facing a retaining attachment of the lower lid in a closed position of the upper lid and the lower lid, and being configured to be rotatable with the upper lid to a locking position with the upper lid and the lower lid in an opened position, wherein the retaining attachment is comprised of an angled end and a chamfered end so as to allow free rotation of the at least one locking attachment to the locking position, wherein a locking recess of the at least one locking attachment is configured so as to house the chamfered end, and wherein a retaining recess is configured so as to partially house the at least one locking attachment.

* * * * *